US007024703B1

(12) United States Patent
Della Ratta

(10) Patent No.: US 7,024,703 B1
(45) Date of Patent: Apr. 11, 2006

(54) MALE FERTILITY ENHANCEMENT GARMENT

(76) Inventor: Peter C. Della Ratta, 824 Union St., Apt 1, Schenectady, NY (US) 12308

( * ) Notice: Subject to any disclaimer, the term of this patent is extended or adjusted under 35 U.S.C. 154(b) by 60 days.

(21) Appl. No.: 10/739,257

(22) Filed: Dec. 18, 2003

(51) Int. Cl.
*A41B 9/02* (2006.01)

(52) U.S. Cl. ..... 2/403; 2/400

(58) Field of Classification Search ..... 2/400–406, 2/228, 227, 238; 604/385.01–396; 602/67–72
See application file for complete search history.

(56) References Cited

U.S. PATENT DOCUMENTS

| | | | | |
|---|---|---|---|---|
| 3,621,846 | A | 11/1971 | Lehman | |
| 4,195,630 | A | 4/1980 | Connery et al. | |
| 4,660,551 | A * | 4/1987 | Nishimura | 600/41 |
| 5,029,345 | A | 7/1991 | Angheluta et al. | |
| 5,157,793 | A * | 10/1992 | Michels | 2/403 |
| 5,283,912 | A * | 2/1994 | Chung | 2/403 |
| 5,290,270 | A * | 3/1994 | Fisher | 604/387 |
| 5,524,298 | A | 6/1996 | Plunkett | |
| 5,598,587 | A * | 2/1997 | Wada | 2/403 |
| 5,647,065 | A | 7/1997 | Richerson | |
| 5,875,495 | A * | 3/1999 | Thrower | 2/403 |
| 6,245,036 | B1 * | 6/2001 | McRoberts et al. | 602/67 |
| 6,295,651 | B1 * | 10/2001 | Kang | 2/403 |
| 6,862,746 | B1 * | 3/2005 | Cym et al. | 2/403 |

FOREIGN PATENT DOCUMENTS

WO WO 02/15726 A1 * 2/2002

* cited by examiner

*Primary Examiner*—Gloria M. Hale
(74) *Attorney, Agent, or Firm*—Fredric T. Morelle

(57) ABSTRACT

A male undergarment providing a comfort barrier between the groin and outer wear with enhancements for promoting male fertility. By use of less restrictive (and confining) garment adjuncts to the conventional undergarment, an environment for genitalia, primarily the testes, is acquired that will reduce the level of body heat accumulating in the zone proximate those organs. Elements are used that will reduce the normal temperatures within that zone by: compartmentally segregating the penis from the scrotum and the latter from the loins; insulating (by suitable fabric) between the segregated organs and groin regions; and, venting the independent, scrotal compartment. Contrary to the modern norm, the genitalia are allowed to assume a more natural, pendulous suspension, one more conducive to the viability of spermatozoa.

16 Claims, 4 Drawing Sheets

MALE FERTILITY ENHANCEMENT GARMENT

CROSS-REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

This invention relates generally to male underwear and specifically to a type of undergarment, irrespective of style, that is adapted to thermally isolate the genitalia from immediate contact with the extreme lower abdomen and upper thigh, i.e., groin regions, by providing selective insulation from body heat and ventilation to the scrotum.

2. Discussion of Relevant Art

Many attempts have been made to enhance male undergarments, for various purposes, including the erotic. The latter, however, is deemed beyond the scope of this disclosure. It is well settled, in the field of medicine, that the close confinement of genitalia, in modern male undergarments, is thermally deleterious to the production of healthy, motile and viable sperm. The instant inventor intends to provide the field of fertility therapy with a garment that does not diverge significantly, in design and function, from conventional underpants, e.g., briefs, shorts or tights. Further, the instant invention, shown in two embodiments, is designed to be non-obtrusive, comfortable and unlikely to attract attention to its user in polite society or in public rest rooms. To achieve the function of fertility enhancement, it is necessary to avoid the tendency to wear tight pants or trousers, which is so much in style today. Unfortunately, body heat, generated at the groin of the body (including the lower abdomen and upper thighs) is often inimical to the male seed. While nature has provided the scrotum, which is pendant by design, to hold the testicles sufficiently away from the body's groin region, so as to maintain a thermal environment conducive to sperm viability, such protection is negated by clothing styles—particularly, underwear. Modern styles (of underpants) take forms ranging from boxer shorts, which allow a modicum of scrotal freedom, to highly restrictive and scrotal-confining tights, pouches, thongs and "trunks". Combined with the wearing of trousers, of even the "regular cut" style, it is intuitive that the temperature in the scrotum will far exceed that of nature's intended environment. There have been many attempts to stylize men's briefs., for many reasons too numerous to address here; however, a search of the U.S. Patent Office Patent Database has yielded a number of patents drawn to such stylization, for whatever reason.

Regarding the search, the patents issued to Connery, et at., U.S. Pat. No. 4,195,630 ('630), and Angheluta, U.S. Pat. No. 5,029,345 ('345), are the most relevant. Connery discloses a scrotal cup inside both briefs and shorts, with a pocket section for the penis. Essentially, he shows compartmentalization and segregation in basic form, but with the scrotum contained within the brief, proper. Angheluta shows a brief that is essentially that of '630, but falls short of it in that the scrotum and penis are neither segregated nor separated by insulation material (the patentee merely alleges insulation by the process of placing the scrotum/penis pouch forward of the brief front panel). Connery cannot be said to have suggested separation of the scrotum and penis from the high thermal groin environment because he has retained the scrotal pouch inside the brief (using solely a thong). Richerson, U.S. Pat. No. 5,647,065 ('065) shows a variation of Angheluta that appears to raise the pouch for the purposes of displaying the covered genitalia more prominently. The article would exaggerate size of, and closely confine, the scrotum and penis to the upper groin area, thus losing the pendulous, cooling effect of their natural suspension. The Lehman patent, U.S. Pat. No. 3,621,846 ('846), discloses what can be truly characterized as a "brief"; it is effectively an athletic supporter that contains the scrotum in a pouch adjacent to the loin/groin area and allows the penis to hang outside the pouch, covered only by a flap or codpiece. The main limitation of '846 is that it performs primarily an athletic support's function, by clearly constraining any scrotal freedom. Plunkett, U.S. Pat. No. 5,524,298 ('298), is an evolution of the Lehman article in that the "brief" of '846 is avoided almost entirely. Here, '298 is a modification of the support, with segregation from the penis and without buttock-encircling straps. The pouch of this garment is essentially the same as '846 and, while the penis is allowed to escape and drape over the top of the pouch, to be covered by a flap element, the article suffers the same limitations as the Lehman device. Although emulating the scrotal pendulum, the device nevertheless confines both organs closely to the groin region.

Incorporation by Reference

Because they show the provision of front panel apertures in men's briefs, as well as the addition of genital organ containment, the following patents to: Connery, et al., U.S. Pat. No. 4,195,630 ('630); Angheluta, U.S. Pat. No. 5,029,345 ('345); and, Richerson, U.S. Pat. No. 5,647,065 ('065), are hereby incorporated by reference.

Definitions

Most terms used herein are to be taken as having their customary English meaning. When different or secondary definitions may be applied, they are given their intended meanings in parentheses. A few terms, however, are to be read with the following meanings (especially, in the claims):

- breathable—having capability of ventilation, e.g., mesh fabric;
- codpiece—a flap element at the front of a pant garment, covering the penis;
- col—a saddle or U-shaped passage or region;
- constrain—to restrain in the sense of holding back or holding closely together;
- ensemble—an assembly of parts, e.g., as in a set or article of clothing;
- fly—a form of codpiece that opens transversely with respect to the body, comprised of two overlapping pieces of the pant; and
- pant(s), also underpants—for the purpose of this disclosure and the appended claims, any of the male undergarments receptive of the instant improvements, including brief(s), shorts or tights.

BRIEF SUMMARY OF THE INVENTION

The limitations of the relevant art are overcome by the concept of a male undergarment that, in addition to providing a comfort barrier between the groin and outer wear, greatly enhances male fertility through usage of less restrictive (and confining) garment adjuncts to the conventional male undergarment, e.g., "briefs", "shorts" or "tights". This is done by combining elements that would promote: (1) a purposeful segregation of penis from scrotum and the latter from the loins; (2) insulating material between segregated organs; and, (3) the venting of the independent, scrotal compartment which is of purposeful, pendulous design.

A first embodiment is applied to the more familiar conventional undergarments (hereinafter, "pants" or "briefs" may be used with the understanding that the invention improvements may be applied to practically any conventional male underwear). An opening is provided in the front panel of the briefs through which, upon dressing, the scrotum and penis are passed. A pouch is provided, conterminously attached to the front panel, in order to receive there into the male organs. This pouch is fashioned with any of the conventional fly apertures or codpieces, to aid in releasing the penis for bladder relief. The entire pouch, or a goodly portion of it, is constructed of a breathable fabric that serves to ventilate the organ(s) thus contained. Interposed the containment (pouch) and the front panel of the briefs is a thermal-insulation material, which may be attached to the front panel or, in itself, form the panel. A light elastic band forms the hem or piping of the front panel aperture. Such an arrangement ensures that ordinary bodily movement, such as sitting, crouching or running, will not cause the scrotum to be withdrawn inadvertently from the pouch.

The alternate embodiment consists likewise of the conventional underpants or briefs, with an opening provided in the front panel of the briefs through which, upon dressing, the scrotum and penis are passed. A bifurcated or dual pouch is provided, again, contermiinously attached to the front panel, in order to receive in one part the scrotum, and in the other, the penis. This dual pouch ensemble is far less constraining than that of the first embodiment, because it avoids the more conventional design, wherein the genitalia are confined tightly into the groin area. The pouches of the instant invention are made, preferably, of a soft mesh fabric. Insulation material, as aforementioned, covers the preponderance of the front panel, as well as a band about the back, bottom and front of the scrotal pouch (compartment) and on the underside of the open-ended pouch (tube) that receives the penis. Thus, the penis is insulated from the scrotum, while the latter is insulated from the brief front panel and groin area. In lieu of the fly aperture, there is provided a front (over the penis containment) flap or codpiece.

DETAILED DESCRIPTION OF THE INVENTION

The general thrust of this disclosure is to present the design of a male undergarment that will enhance fertility by promoting a thermally more natural environment for the testicles, without wandering afar of modern style or human dignity. For this reason, particularly the latter, but with an eye toward optimizing sperm motility, the inventor has eschewed the practice of engaging and lifting the genitalia and sought to release them into a more natural, pendulous posture. This is indeed the reason that nature provides a pendant scrotum—to avoid the excessive, sperm threatening body heat that accumulates within the groin area of the male. The improvements made to the customary male underwear are: physical segregation of the genitalia from the wearer's groin or crotch area (of the wearer); thermal isolation of the genitalia from that body area; in an alternate embodiment, discrete compartmentalization of scrotum and penis; and, ventilation of the genitalia by the use of breathable fabric, such as a soft, cotton mesh. The invention will be better appreciated with a detailed description, in view of the drawings.

Figure 1:
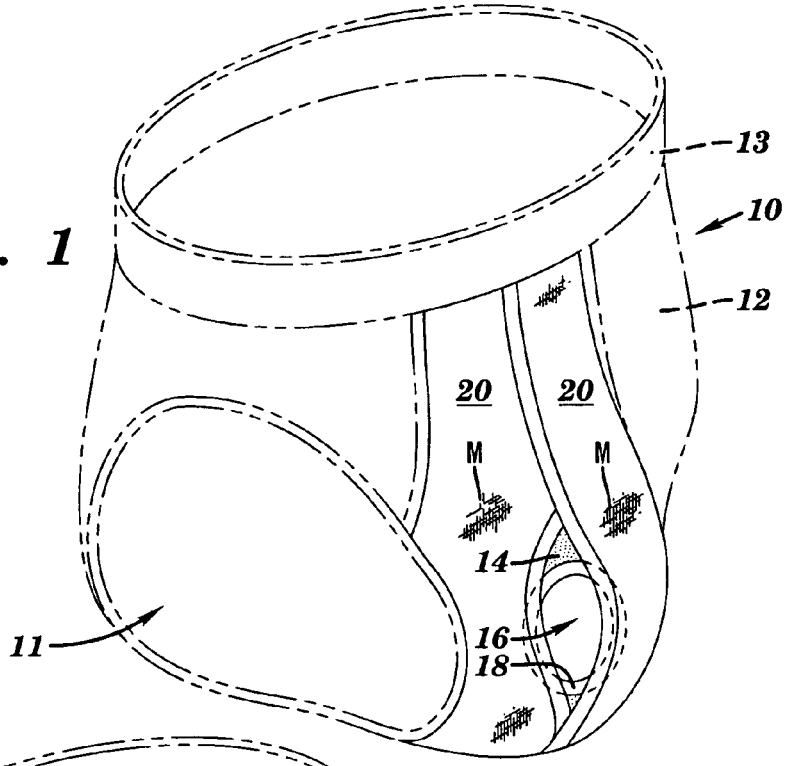
FIG. 1 is an illustration of the nominal undergarment of the invention, a (set of) briefs embodying the invention.
Figure 5:
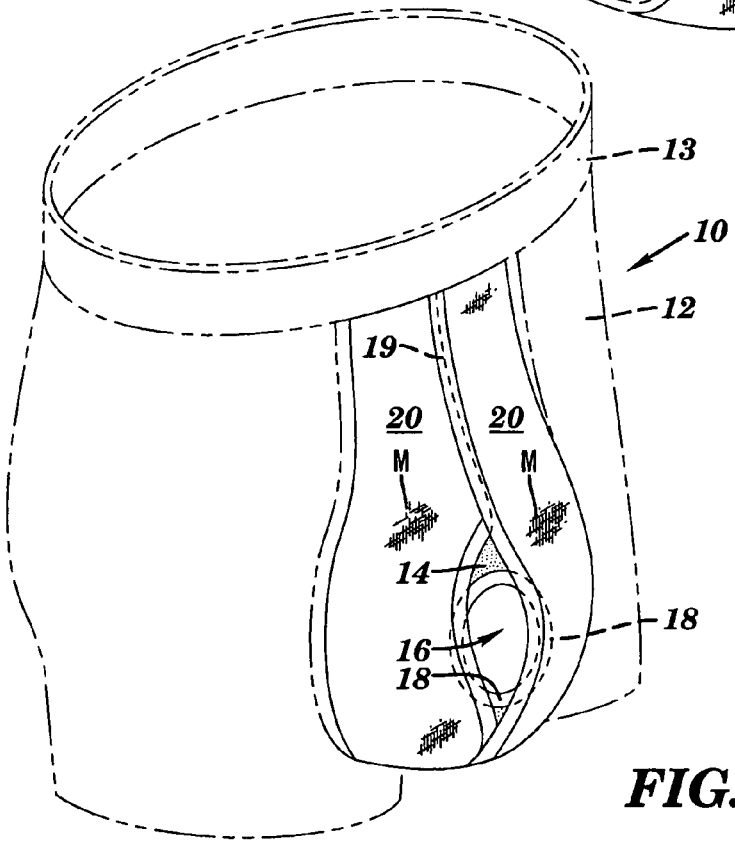
FIG. 5 is an illustration of a pair of tights displaying the invention.

Referring to FIG. 1, the invention 10 consists in a conventional male undergarment 12 that encompasses the hips, buttocks, lower abdomen, groin and, in some versions, the upper thighs. The garment shown is common to its counterparts of the genre, in that it shows the elastic waistband 13, leg ports 11 and pocket-fly 20 (termed "pouch", in the first-shown embodiment of the invention); the latter being a particular type of codpiece. In this illustration, the buttock- and hip-covering portions of the brief are shown as a fabric, but were this invention applied to that type of undergarment known as the thong, the principal parts—waistband 13, front portion 14 and fly cum pouch 20—would still be realized, with but two straps (not shown), passing under the saddle or col portion of the garment, to the waistband. It is not the instant inventor's intention to dwell on the various types of male undergarments, but rather to illuminate the reader as to the particular improvements that constitute the instant invention. These can be applied to almost all such garments for the purpose of enhancing sperm viability, as well as offering to the wearer more than a modicum of natural comfort.

Adding comfort, to the more natural suspension of the genitalia, is the use of a soft mesh M fabric that composes most-to-all of the pouch 20. The front panel 14 is made special to the invention by its unique construction, employing insulation fabric of practically any type used in the clothing industry even, for example, the standard cotton or cotton/polyester materials, from which men's underwear is generally fashioned. Most available thermal underwear fabrics are suitable. Should the fabricator of the invention choose, washable, heat-reflective materials may be used within or on the front portion to grant it the desired insulation quality.

In this embodiment, use of a low aperture 16 disposed in the special front portion (panel) 14 allows easy passage of the genitalia, through the elastic-hemmed 18 aperture 16. The conventional front panel-fly is permuted to a pouch form and now serves the dual purpose of providing a vented and insular containment of the genitalia, while still allowing extraction of the penis for urination.

Figure 2:
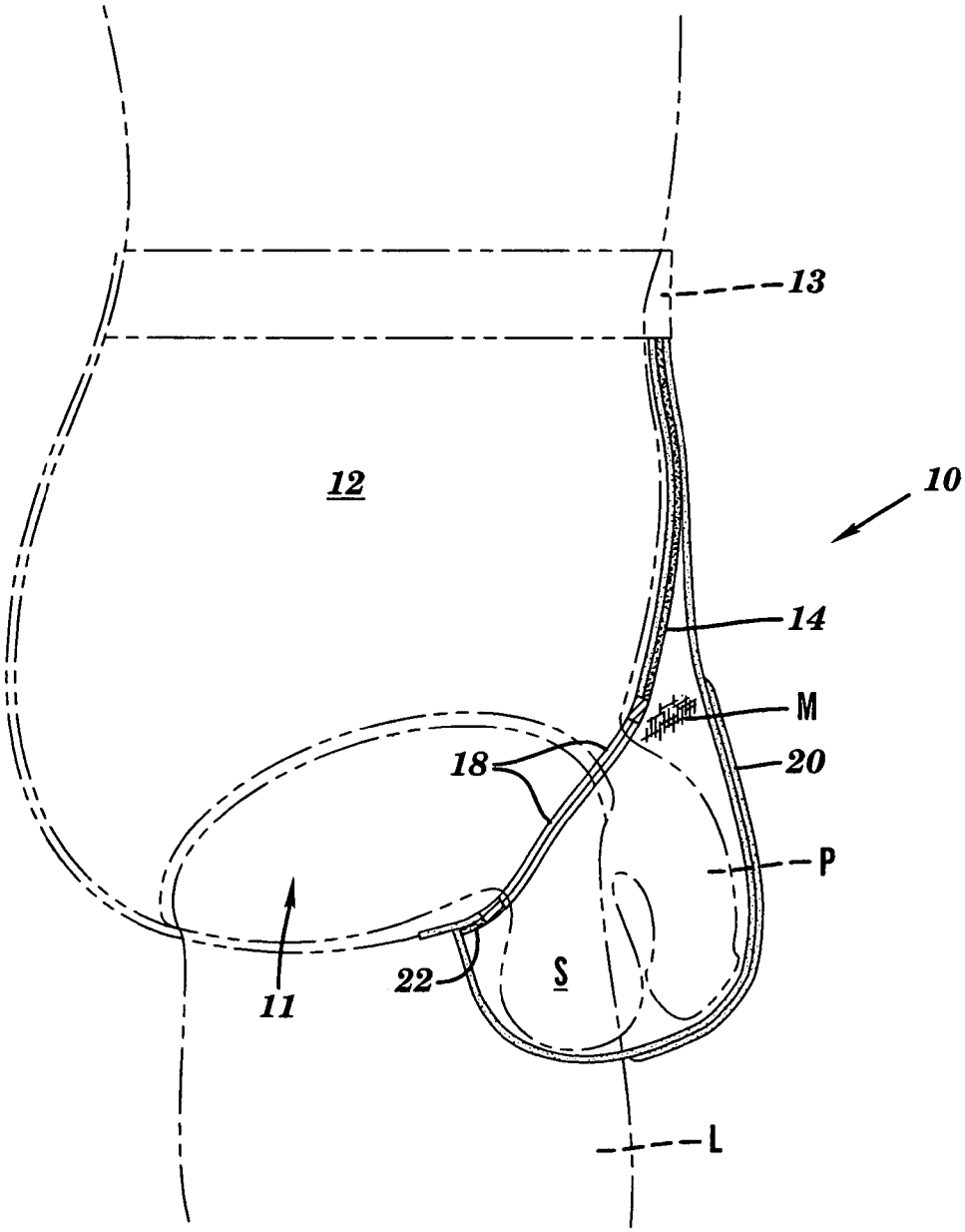
FIG. 2 is an cross sectional elevation, in partial phantom, of the FIG. 1 article.

The cross-sectional side elevation of FIG. 2 presents the invention 10, with a somewhat exaggerated posture of the genitalia, in order to clearly define the elements of the improvements. Parts of the conventional brief, as well as physical body parts, are shown (in phantom) as buttock-hip covering 12, waistband 13 and leg L, scrotum S, penis P, respectively. It may be seen that the special front portion 14 of the brief is used in lieu of the conventional panel and the elastic-hemmed 18 aperture receives passage of the genitalia there through, into the pouch 20. A portion of the special insulation panel is shown in the col 22 region, to indicate that it (insulation) may be carried below the scrotum and on to the lower portion of the pouch, to further insulate the scrotum S from body heat in the upper thigh-crotch area. Irrespective of insulation on the pouch, most of the pouch construction should be of a breathable fabric, such as the earlier-suggested mesh M.

Figure 3:
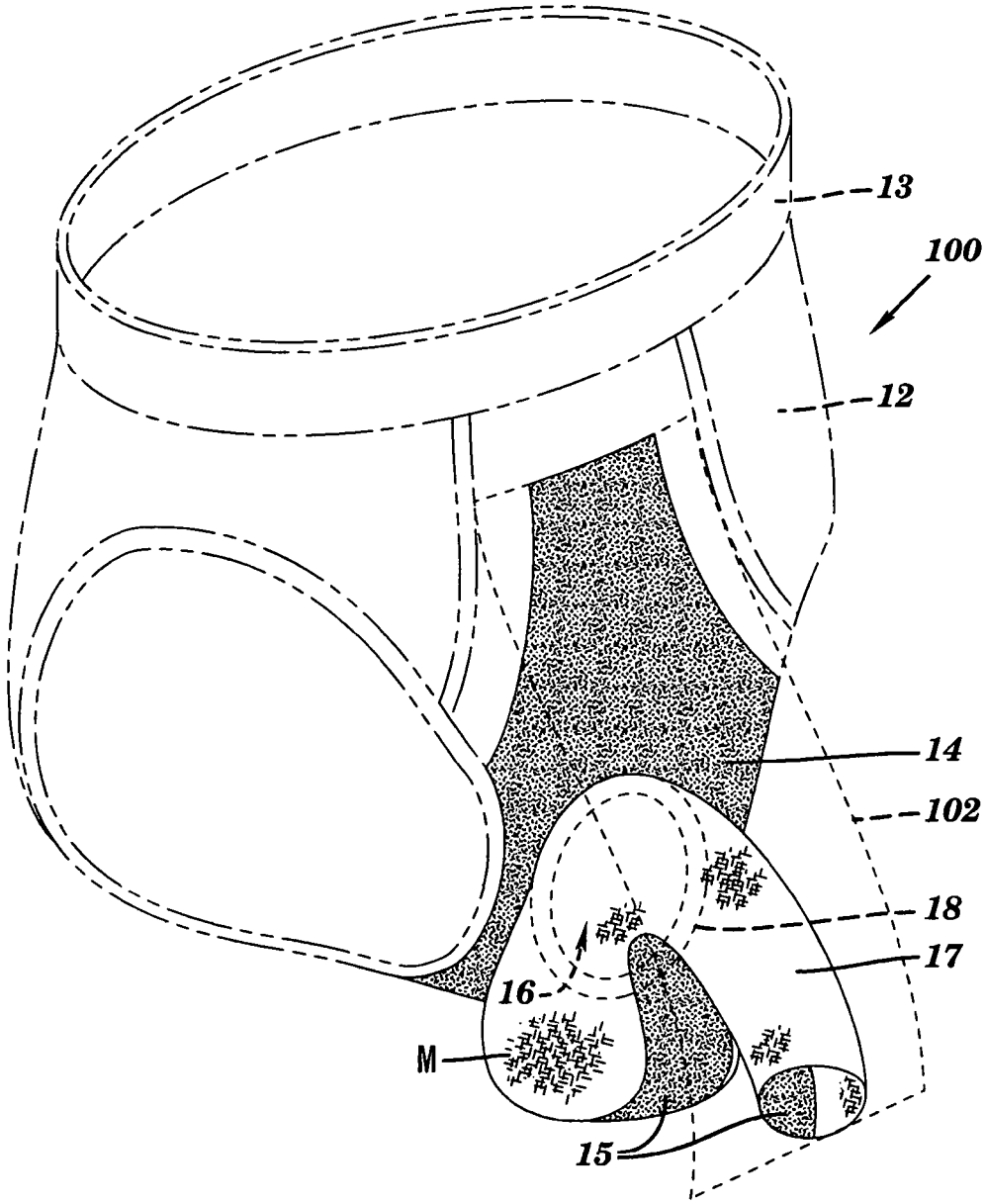
FIG. 3 is an illustration of the alternate embodiment of the invention.
Figure 4:
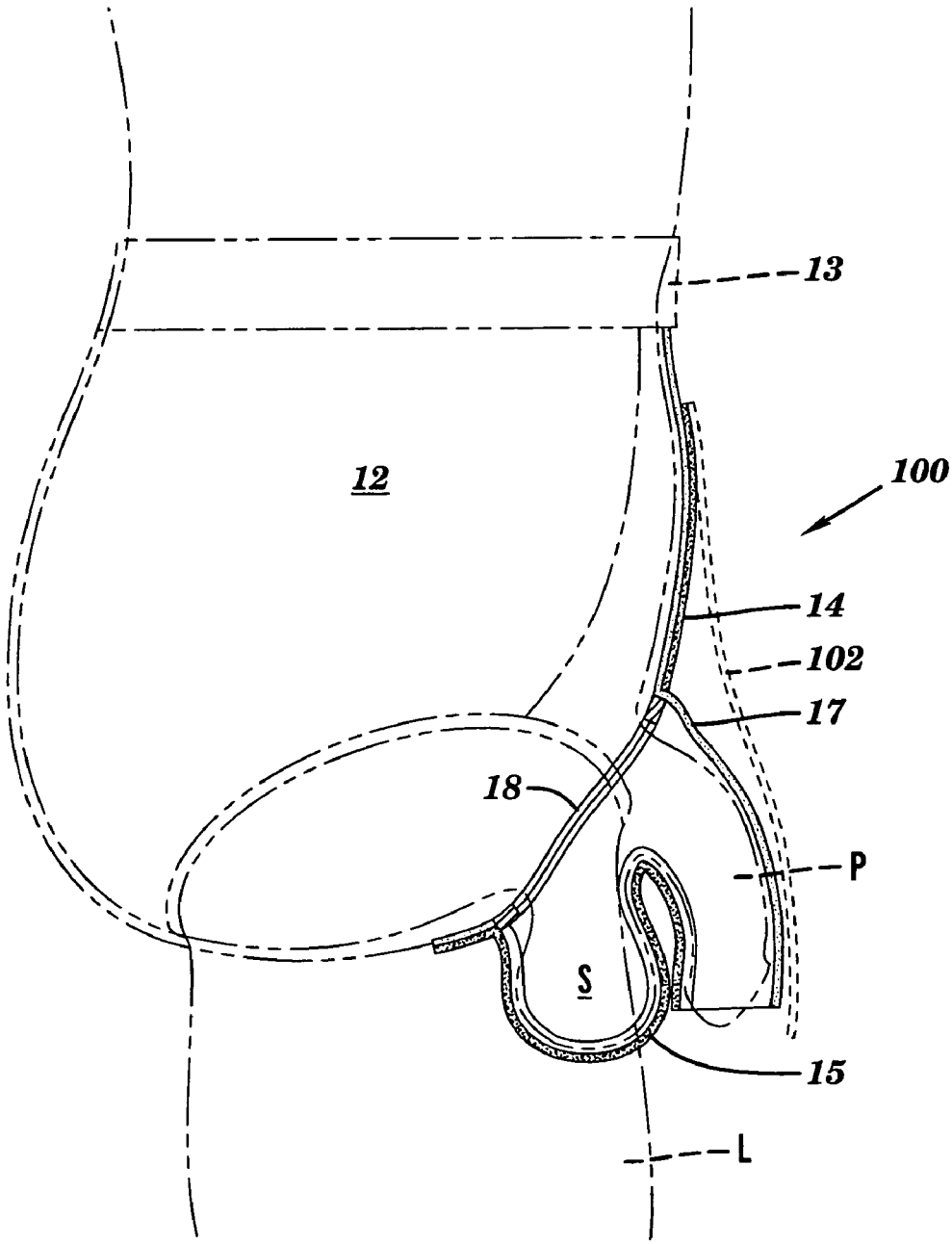
FIG. 4 is a cross sectional elevation, in partial phantom, of the FIG. 3 article.

The alternate embodiment 100 of the invention, as seen in FIGS. 3 and 4, bears many of the elements of the first embodiment 10. Insofar as the improvements however, the frontal pouch is dispensed with in favor of a bifurcated pouch 17 consisting of a scrotal pouch or compartment, communicating with its compliment, a tubular, open-ended sleeve; the latter being receptive only of the penis P. Distinctions are noted in that: the insulated panel 14 is a portion that covers only part of the front panel, but all of the groin area; and, an exception is made to a preponderant mesh M construction of the pouch 17, by use of a partial insulation strip 15 that runs from the col region (FIG. 2 at 22) under and over the scrotal section of the pouch, but only under the tubular section that is reserved for the penis.

Under most circumstances, the arrangement of elements disclosed is sufficient to the invention. Depending on the over garment worn (trousers, jeans or shorts), more protection may be desired between the penis and the outerwear. To this end, the invention is fitted with the traditional codpiece 102 which, in keeping with the spirit of the invention, ought to be fabricated of breathable material.

What is claimed is:

1. A male pant undergarment having at least a defined front portion for coverage of genitalia at the lower extremis of abdomen and groin area of a wearer of the undergarment, and comprising:

said front portion featuring a singular hole disposed there through and proximate said genitalia, the singular hole suitable for a displacement of the wearer's genitalia there through, the front portion including a heat-insulation means for thermally isolating the genitalia from said groin area; and a singular two-part element made of a breathable fabric, for receiving therein said genitalia, said element circumferentially attached to and depending from said singular hole, the element further comprising a lower, substantially closed scrotum-receptive pouch and an upper, open ended penis-receptive sleeve, a lower margin of the sleeve being conterminous with an upper margin of the pouch.

2. The undergarment of claim 1, wherein said hole is hemmed with a light elastic material.

3. The undergarment of claim 1, wherein a thermal insulating fabric is overlain a substantial part of said front portion, thereby thermally isolating from said groin area the genitalia displaced through said hole.

4. The undergarment of claim 1, wherein said pouch is constructed of a breathable, ventilating fabric, thereby effecting an escape of genitalia heat from the pouch.

5. A male undergarment comprising:

at least a clothing member for covering the male groin having a defined genitalia-covering front part, said front part featuring therein a solitary aperture suitable for passing the genitalia there through and outside said front part;

a unitary containment for receiving said genitalia therein and isolating said genitalia from said groin; and an insulation means disposed on the front part to thermally isolate it from said containment.

6. The undergarment of claim 5, wherein said clothing member is selected from the class of garments consisting of briefs, shorts, and pants.

7. The undergarment of claim 5, wherein said solitary aperture is an opening hemmed with an elastic material effecting a light cinching of said front part about the root of the genitalia.

8. The undergarment of claim 7, wherein said unitary containment is a bifurcated envelope further comprising a scrotum-receptive pouch contiguous with an open ended penis-receptive sleeve.

9. The undergarment of claim 6, wherein said containment is constructed substantially of a breathable material effective for ventilating said compartment and said sleeve.

10. The undergarment of claim 6 wherein said insulation means comprises at least a thermal insulation disposed about said opening and extending at least partially over the front parts of said class of garments.

11. The undergarment of claim 5, wherein said insulation means further comprises a thermal insulation strip disposed from the root of, and under, the containment to further thermally isolate it from the thigh region.

12. The undergarment of claim 8, wherein said insulation means further comprises a thermal insulation strip disposed on a top surface of the pouch and on an underside of the sleeve, thereby thermally isolating the sleeve from the pouch.

13. A clothing assembly, defining a male fertility-enhancement undergarment that is characterized by:

a pant having a defined frontal portion bearing therein a single, inherently expandable-contractible aperture that is disposed in a lower part of the frontal portion so as to allow a user's genitalia to pass there through to effect a natural state of suspension; and a bi-furcated pouch means for envelopment of the user's genitalia and annularly fixed to the aperture, said pouch characterized by a lower pocket, for receiving therein the scrotum, and an open-ended sleeve, receptive therein of the penis, said pouch effecting segregation of the genitalia from the pant interior; and said open-ended sleeve disposed for substantial enclosure of penis.

14. The assembly of claim 13, wherein said pant is selected from the class of garments consisting of briefs and shorts.

15. The assembly of claim 13, wherein the pouch means is constructed substantially of a soft mesh effective for ventilating said pocket and said sleeve.

16. The assembly of claim 15, further characterized by a thermal insulation strip disposed on components of the pouch so as to thermally isolate the penis from the scrotum while allowing said ventilation at laterals of the pouch.

* * * * *